United States Patent [19]

Middleton

[11] Patent Number: 4,770,274

[45] Date of Patent: Sep. 13, 1988

[54] SAW HORSE BRACKET

[76] Inventor: Forest L. Middleton, C-1506 Barlow Lake, Middleville, Mich. 49333

[21] Appl. No.: 141,137

[22] Filed: Jan. 6, 1988

[51] Int. Cl.[4] ..... B27B 21/00; 182 181

[52] U.S. Cl. ..... 182/185; 182/224

[58] Field of Search ..... 182/181, 182, 183, 184, 182/185, 186, 224, 226

[56] References Cited

U.S. PATENT DOCUMENTS

| | | | |
|---|---|---|---|
| 1,352,188 | 9/1920 | Giles . | |
| 1,908,858 | 5/1933 | O'Kane et al. . | |
| 2,343,557 | 3/1944 | Johnson . | |
| 2,533,776 | 12/1950 | Dustman | 182/185 |
| 2,973,053 | 2/1961 | Beaty . | |
| 3,055,453 | 9/1962 | Vanyo . | |
| 4,018,484 | 4/1989 | Miller . | |
| 4,192,406 | 3/1980 | Mitchell | 182/185 |
| 4,570,752 | 2/1986 | Chapman et al. . | |

*Primary Examiner*—Reinaldo P. Machado

*Attorney, Agent, or Firm*—Price, Heneveld, Cooper, DeWitt & Litton

[57] ABSTRACT

A saw horse bracket and resulting saw horse which may be easily assembled and disassembled solely through the use of a pair of the novel mounting brackets. The mounting brackets include a pair of identically-shaped bracket members which are fixedly joined together and include a susbstantially channel-shaped body which defines a cavity therein for receiving the legs of the saw horse, connecting flanges which extend forwardly from each bracket member and overlap with the connecting flanges of the other bracket member, a fastening arrangement which fixedly joins the overlapping connecting flanges, and a mounting flange which is received within openings in the cross beam.

14 Claims, 2 Drawing Sheets

SAW HORSE BRACKET

BACKGROUND OF THE INVENTION

The present invention pertains to saw horse and trestle structures, and particularly to such structures of the knock-down variety.

Saw horse structures have been utilized as economical and efficient supports in innumerous uses for many years. Yet, despite their light, durable nature, saw horse supports, especially in a small shop environment or in transport to a construction site or the like, occupy a substantial amount of space. Past artisans have developed several saw horse assemblies which are capable of being broken down into its separate parts or folded into a compact arrangement for easy storage or transport with a minimal amount of space. However, these systems are believed to have all involved complex structural arrangements involving a multiplicity of moving parts, linkages, nut and bolt assemblies, specifically configured legs and cross beams, etc. All of which, while enabling the saw horse to be oriented in a compact state, but because of their complex nature significantly add to the cost of fabrication, the susceptibility of disrepair and the amount of time in a set-up procedure.

SUMMARY OF THE INVENTION

The aforementioned problems are overcome in the present invention, wherein a unique and effective saw horse assembly bracket is provided to facilitate quick and easy assembly or disassembly of a saw horse structure.

Essentially, the bracket includes a pair of identically-shaped members fixedly coupled together to easily receive conventional pieces of wood, preferably a standard "two-by-four" or the like in the assembly of a saw horse structure. The bracket is preferably fabricated from sheet metal which is cut and bent into a particular configuration. The bracket involves no moving parts, is of a unitary construction, and requires the fabrication of only one type of element. Hence, the saw horse bracket of the present invention is extremely durable and inexpensive to manufacture, easily adaptable to home uses, and readily permits the saw horse structure to be broken down into its separate elements for storage or transport purposes.

These and other objects, advantages and features of the present invention will be more fully understood and appreciated by reference to the written specification and appended drawings.

DETAILED DESCRIPTION OF THE PREFERRED EMBODIMENT

Figure 1:
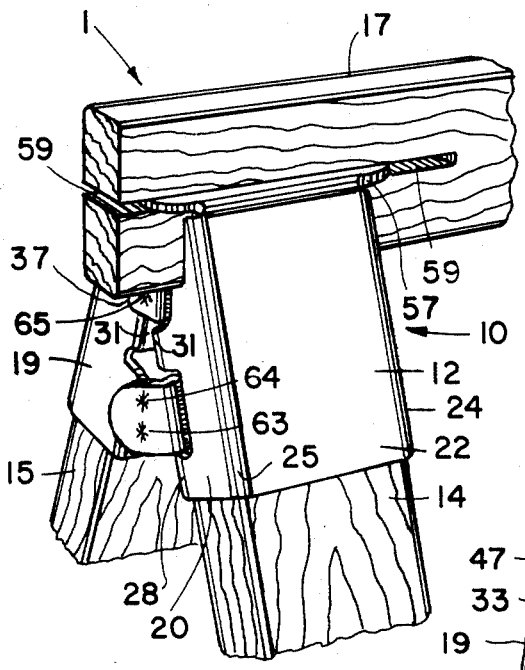
FIG. 1 is a perspective view of an end of a saw horse utilizing the saw horse bracket of the present invention.
Figure 2:
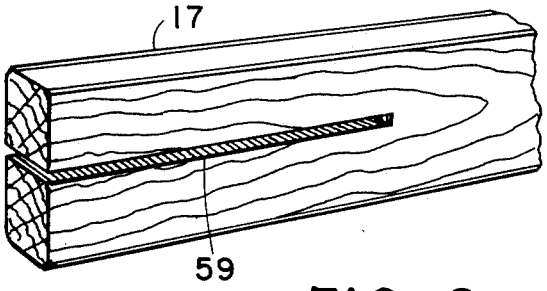
FIG. 2 is a perspective view of an end of a support beam adapted for use with the saw horse bracket of the present invention.
Figure 3:
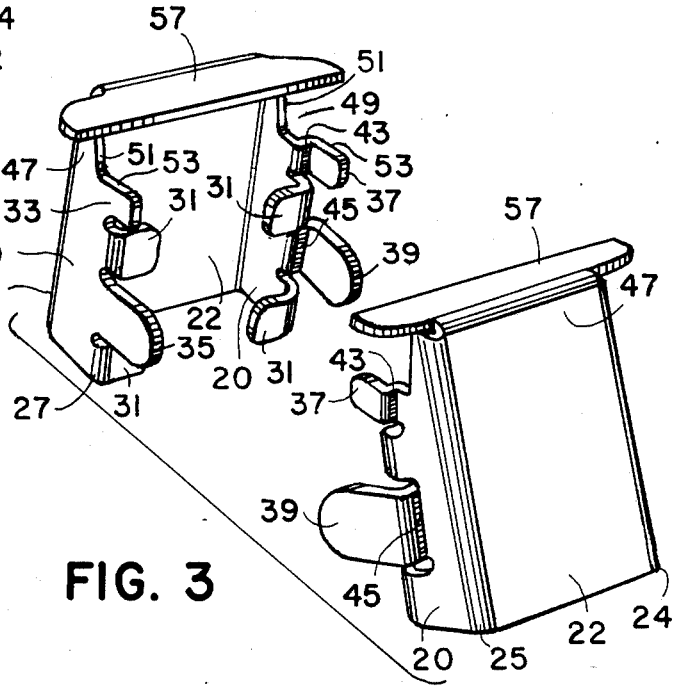
FIG. 3 is an exploded view of the saw horse bracket.
Figure 4:
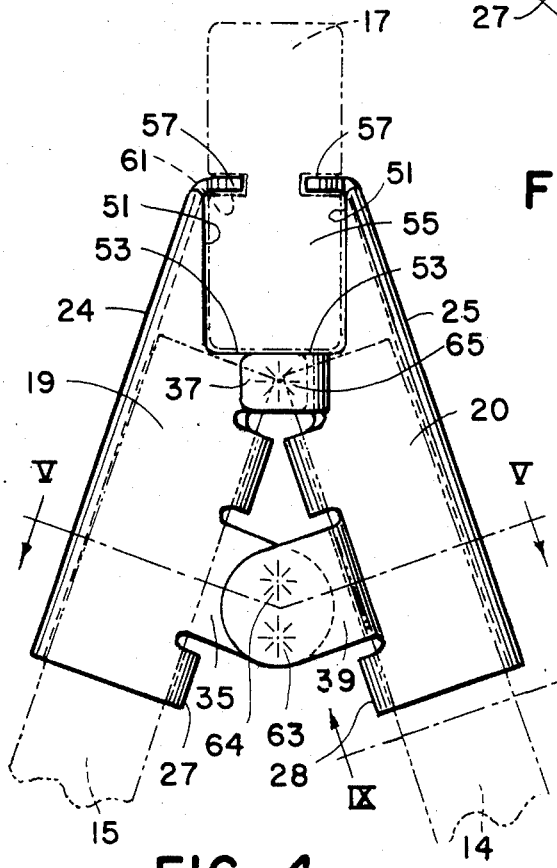
FIG. 4 is a side elevational view of the saw horse bracket.

In the preferred embodiment, saw horse and trestle structures are formed through the use of saw horse brackets 10 comprised of two identically shaped bracket members 12 which are fixedly coupled together in a substantially V-shaped configuration (FIG. 4). Each bracket 10 is configured to cooperatingly receive two legs 14, 15 and an end of a cross beam 17 to therewith form an assembled saw horse.

Bracket member 12 is preferably composed of sheet metal, but could be formed of other materials possessing the requisite characteristics. Bracket member 10 is of a substantially channel-shaped configuration having a pair of parallel legs 19, 20 and a bight 22 interconnecting the rearward edges 24, 25 thereof. Preferably, bracket legs 19, 20 are spaced apart to matingly receive therebetween a conventional "two-by-four". Of course, it could be dimensioned to matingly receive differently dimensioned member.

Projecting inwardly from forward edge 27, 28 of each leg 19, 20 is a pair of spaced apart holding flanges 31. Each holding flange 31 is substantially parallel to one bight 22, and defines together with that bight 22 and corresponding legs 19, 20 an opening 29. Openings 29 matingly receive therein the ends of saw horse legs 14, 15 to hold them in place.

Also projecting from forward edges 27, 28 of bracket legs 19, 20 are a plurality of forwardly extending connecting flanges 33, 35, 37, 39. More specifically, extending from bracket leg 19 is an upper connecting flange 33 and a lower connecting flange 35 which both lie in the same plane as leg 19. However, upper and lower connecting flanges 33, 35 differ in both size and orientation. Lower connecting flange 35 is substantially larger in both the transverse and longitudinal directions than upper connecting flange 33. Also, lower connecting flange 35 extends orthogonally to leg 19, while upper connecting flange 33 is offset at a small acute angle such as approximately 20 degrees therefrom. Projecting forwardly from bracket leg 20 is a corresponding pair of upper and lower connecting flanges 37, 39. Connecting flanges 37, 39 are identical to connecting flanges 33, 35, with the exception that they are spaced from bracket leg 20 by offset flanges 43, 45. Offset flanges space connecting flanges 39, 37 a distance substantially equal to the thickness of connecting flanges 33, 35 so that bracket members 12 may be easily interconnected and fastened together.

Figure 5:
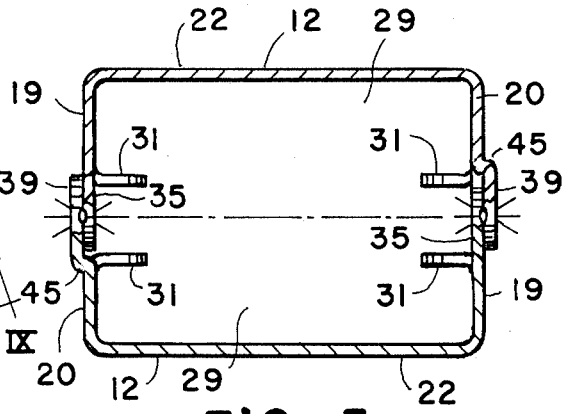
FIG. 5 is a cross-sectional view of the saw horse bracket taken along line V—V.
Figure 6:
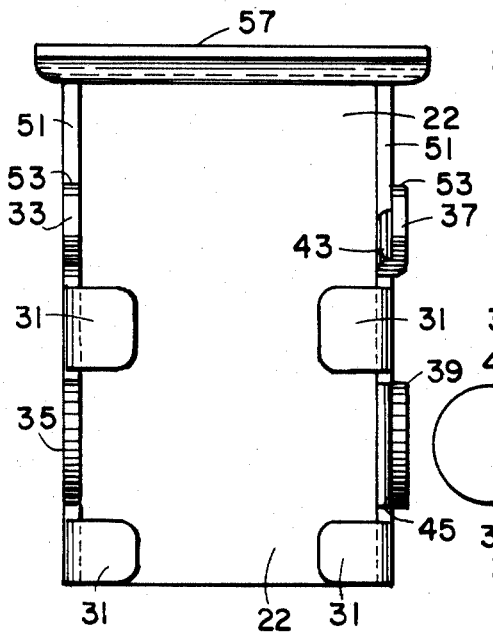
FIG. 6 is a front view of the saw horse bracket.
Figure 7:
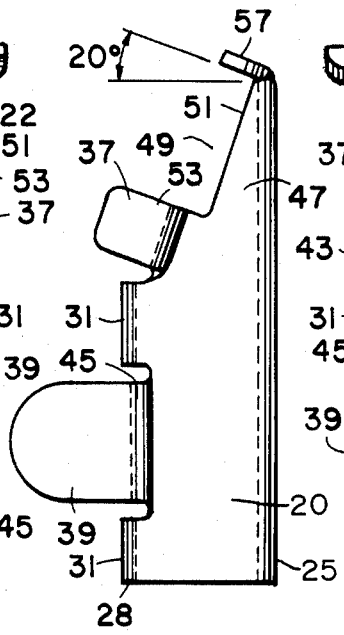
FIG. 7 is a side elevational view of the saw horse bracket.
Figure 8:
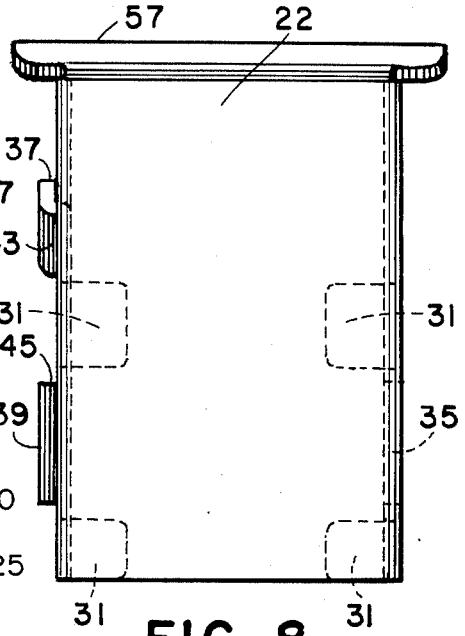
FIG. 8 is a rear view of the saw horse bracket.
Figure 9:
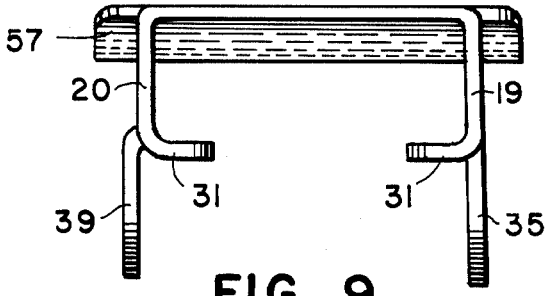
FIG. 9 is a bottom view of the saw horse bracket.

As is clearly seen in FIGS. 4 and 5, bracket members 12 are interlocked and fixed together via connecting flanges 33, 35, 37, 39. Preferably, bracket members 12 are fixedly coupled together through the use of rivets or bolts, but could be coupled by other means, such as by welding. In the most preferred embodiment, two aligned rivets would be placed through lower connecting flanges 37, 39 at 63, 64 and a third aligned rivet would be passed through upper connecting flanges 33, 35 at 65. Once fastened together, bracket members 12 form a substantially V-shaped configuration in which they are preferably approximately 40 degrees apart.

Upper portions 47 of each bracket member 12 are provided with a notch 49 defined in the forward edge 27, 28 of each bracket leg 19, 20. More specifically, notches 49 are defined by top edge 51 extending vertically when assembled, and upper edge 53 of each upper connecting flange 33, 35. Upper edges 53 extend perpendicularly to top edges 51 so as to receive a corner of cross beam 17. As illustrated in FIG. 4, notches 49 are positioned in opposing relationship to define a cavity 55 which matingly receives therein lower half of cross beam 17. Further, due to the non-perpendicular extension of upper connecting flanges 33, 37, upper edges 53 together form a horizontal support surface which is flush with the bottom surface of cross beam 17. This arrangement permits upper connecting flanges 33, 37 to effectively distribute the weight of any load placed upon cross beam 17.

When a load is placed upon cross beam 17 it is received by upper connecting flanges 33, 35 and therefrom transferred through bracket 10 to saw horse legs 14, 15. Rivets, bolts or the like at 63, 64, 65 are designed to resist the shear stresses incurred and hold the bracket members together in a secure arrangement. Due to the application of the load, bracket 10 undergoes a slight flexing, such that vertical edges 51 are pressed against the sides of cross beam 17. This flexing effects a gripping arrangement which acts to prevent the saw horse from being inadvertently disassembled through slippage, bumping, etc.

Extending forwardly along the top of each bracket member 12 is a mounting flange 57. Mounting flanges 57 extend forwardly from bracket members 12 in a direction which is substantially parallel to upper connecting flanges 33, 35. The two flanges 57 on opposite sides project toward each other in the same plane. Mounting flanges 57 are adapted to be received within kerf 59 provided axially through the end of cross beam 17. Also note that a pair of grooves 61 may be provided in place of kerf 59 (FIG. 4). Kerf 59 may be easily made at the time of saw horse fabrication or at home by a user, and represents the sole modification (besides determining their length, if necessary) that must be made to a collection of "two-by-fours" which are to be used with the saw horse brackets 10 of the present invention.

Figure 10:
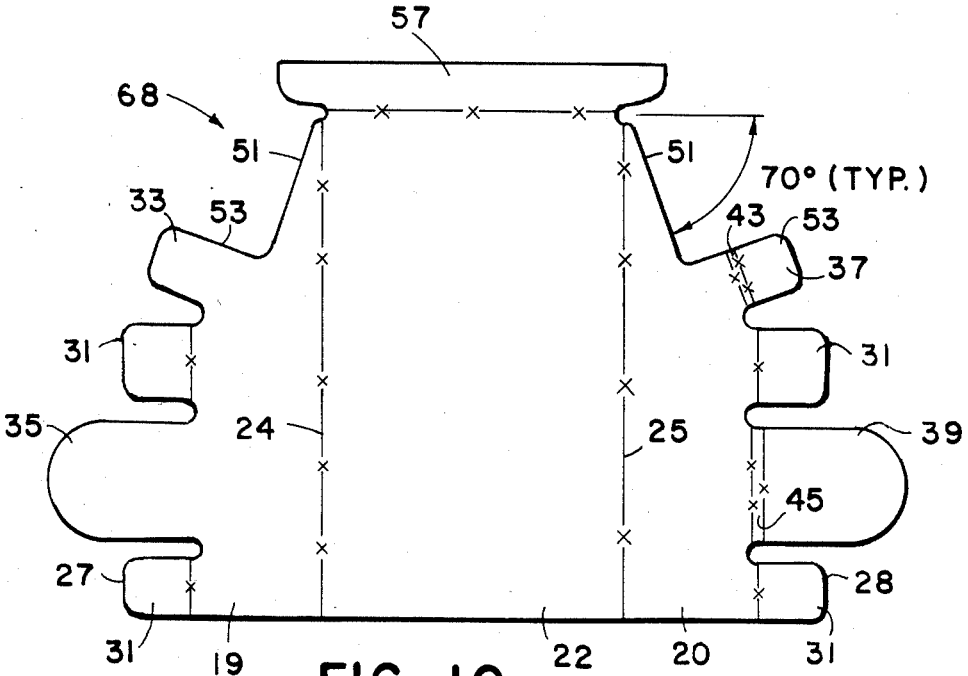
FIG. 10 is a plan view of the cut sheet metal blank before it is folded into its unique final configuration.

Moreover, not only is saw horse 1 easy to assemble through the use of brackets 10, but also the brackets themselves are readily manufactured. In the preferred embodiment, sheet metal is initially taken and cut into a blank 68 with the configuration shown in FIG. 10. Thereafter, the sheet metal undergoes a series of bending steps to form junctures represented by lines 63 (FIG. 10). Also, since bracket members 12 are identically shaped, only one forming procedure need be designed. Hence, saw horse brackets 10 may be quickly and economically manufactured.

In summary, saw horse 1 may be assembled solely through the use of pair of brackets 10 and five lengths of conventional "two-by-fours". Four of the lengths are used as saw horse legs 14, 15 and are received within openings 29 defined by bracket legs 19, 20, bights 22 and holding flanges 31. The fifth length of "two-by-four" is used as a cross beam 17 and is provided with a horizontal kerf 59 extending axially inward on opposite sides from each end. Cross beam 17 is securely held in cavity 55 by receiving mounting flanges 57 within kerf 59. Upper connecting flanges 33, 35 engage lower edge of cross beam 17 and receive and distribute the weight placed thereupon to the extended saw horse legs 14, 15.

It is to be understood that the above descriptions are those of the preferred embodiments of the invention. Various other embodiments, as well as many changes and alterations within the concept taught, may be made without departing from the spirit and broader aspects of the invention as defined in the claims.

The embodiments of the invention in which an exclusive property or privilege is claimed are defined as follows:

1. A saw horse bracket forming a saw horse having a plurality of legs and a cross beam which is easily assembled and disassembled, wherein said bracket comprises:

a pair of identically shaped bracket members fixedly coupled together in a substantially V-shaped configuration, wherein each said bracket member includes:

(a) a substantially channel-shaped body to receive the legs;

(b) connecting flanges which are overlapped when said bracket members are joined to form said bracket;

(c) means for fixedly coupling together said overlapping connecting flanges whereby said bracket members are fixedly coupled together; and (d) a mounting flange which extends forwardly from said body to be received within opposing recesses in the cross beam.

2. The bracket of claim 1 in which said connecting flanges include a plurality of overlapped first flanges which together define a horizontal supporting surface which is adapted to engage and support said cross beam whereby any weight placed thereupon may be distributed to the saw horse legs.

3. The bracket of claim 2 in which each said body is provided with at least one forward edge, wherein said forward edges are positioned in an opposed relationship with one another, an upper portion of each forward edge is oriented orthogonally with said supporting surface to form therewith a cavity which is configured to matingly receive said cross beam and grip the sides thereof when the load is placed on the cross beam.

4. The bracket of claim 1 in which said bracket members are each formed solely by bending a pre-cut piece of sheet metal, whereby said bracket members are fabricated as a unitary piece.

5. A saw horse bracket forming a saw horse having a plurality of legs and a cross beam which is easily assembled and disassembled, wherein said bracket comprises:

a pair of identically shaped bracket members fixedly coupled together in a substantially V-shaped configuration, wherein each said bracket member includes:

(a) a substantially channel-shaped body having a pair of parallel legs with forward and rearward edges and a bight interconnecting said legs;

(b) two sets of connecting flanges in which one set projects forwardly from said forward edge of each said bracket leg, each set includes at least one connecting flange, and wherein one said set is oriented relative to one said bracket leg in a manner which is different than the orientation of the other said set relative to the other said bracket leg, whereby said connecting flanges are overlapped when said bracket members are joined to form said bracket;

(c) means for fixedly coupling said overlapping connecting flanges whereby said bracket members are fixedly coupled together; and (d) a mounting flange which extends forwardly from said body to be received within opposing recesses in the cross beam, whereby said saw horse is easily assembled in a secure interconnected manner without the need for additional fastening means.

6. The bracket of claim 5 in which connecting flanges are formed of a predetermined thickness, and in which said one set lies within the same plane as said one bracket leg and in which said other set lies within a plane which is offset from said other leg a distance equal to the thickness of said connecting flange of said one set, whereby said overlapping connecting flanges are juxtaposed in a contiguous relationship with one another when said bracket members are joined together.

7. The bracket of claim 5 further including at least one holding flange which projects inwardly from the forward edge of at least one bracket leg in a position substantially parallel to said bight and in cooperation with said body defines said cavity which is adapted to receive therein one of the saw horse legs.

8. The bracket of claim 7 in which said bracket members are each formed solely by bending a pre-cut piece of sheet metal, whereby said bracket members are fabricated as a unitary piece.

9. A saw horse which may be easily assembled and disassembled comprising:

a cross beam and a plurality of legs; and at least one bracket which comprises a pair of identically shaped bracket members fixedly coupled together in a substantially V-shaped configuration, wherein each said bracket member includes:

(a) a substantially channel-shaped body to receive the legs;

(b) connecting flanges which are overlapped when said bracket members are joined to form said bracket;

(c) means for fixedly coupling said overlapping connecting flanges whereby said bracket members are fixedly coupled together; and (d) a mounting flange which extends forwardly from said body to be received within opposing recesses in the cross beam.

10. The saw horse of claim 9 in which said connecting flanges include a plurality of overlapped first flanges which together define a horizontal supporting surface which is adapted to engage and support said cross beam whereby any weight placed thereupon may be distributed to the saw horse legs.

11. The saw horse of claim 10 in which each said body is provided with at least one forward edge, wherein said forward edges are positioned in an opposed relationship with one another, an upper portion of each forward edge is oriented orthogonally with said supporting surface to form therewith a cavity which is configured to matingly receive said cross beam and grip the sides thereof when the load is placed on the cross beam.

12. A saw horse which may be easily assembled and disassembled comprising:

a cross beam and a plurality of legs; and at least one bracket which comprises a pair of identically shaped bracket members fixedly coupled together in a substantially V-shaped configuration, wherein each said bracket member includes:

(a) a substantially channel-shaped body having a pair of parallel legs with forward and rearward edges and a bight interconnecting said legs;

(b) two sets of connecting flanges in which one set projects forwardly from said forward edge of each said bracket leg, each set includes at least one connecting flange, and wherein one said set is oriented relative to one said bracket leg in a manner which is different than the orientation of the other said set relative to the other said bracket leg, whereby said connecting flanges are overlapped when said bracket members are joined to form said bracket;

(c) means for fixedly coupling said overlapping connecting flanges whereby said bracket members are fixedly coupled together; and (d) a mounting flange which extends forwardly from said body and is received within opposing recesses in the cross beam, whereby said saw horse is easily assembled in a secure interconnected manner without the need for additional fastening means.

13. The saw horse of claim 12 in which connecting flanges are formed of a predetermined thickness, and in which said one set lies within the same plane as said one bracket leg and in which said other set lies within a plane which is offset from said other leg a distance equal to the thickness of said connecting flange of said one set, whereby said overlapping connecting flanges are juxtaposed in a contiguous relationship with one another when said bracket members are joined together.

14. The saw horse bracket of claim 12 further including at least one holding flange which projects inwardly from the forward edge of at least on bracket leg in a position substantially parallel to said bight and in cooperation with said body defines said cavity which is adapted to receive therein one of the saw horse legs.

* * * * *

UNITED STATES PATENT AND TRADEMARK OFFICE

CERTIFICATE OF CORRECTION

PATENT NO. : 4,770,274

DATED : September 13, 1988

INVENTOR(S) : Forest L. Middleton

It is certified that error appears in the above-identified patent and that said Letters Patent is hereby corrected as shown below:

Column 6, Claim 14, Line 44:

"on" should be -- one --.

Signed and Sealed this

Twenty-eighth Day of March, 1989

*Attest:*

DONALD J. QUIGG

*Attesting Officer*

*Commissioner of Patents and Trademarks*